US005682595A

United States Patent [19]

Gonseth et al.

[11] Patent Number: 5,682,595

[45] Date of Patent: Oct. 28, 1997

[54] HIGH TOUGHNESS CERAMIC/METAL COMPOSITE AND PROCESS FOR MAKING THE SAME

[75] Inventors: Denis Gonseth, Founex; Daniele Mari, Lausanne; Paul Bowen, Nyon, all of Switzerland; Claude Paul Carry, Versailles, France; Pascal Streit, Vufflens La Ville; Roberto Mulone, Borex, both of Switzerland

[73] Assignee: UFEC- Universal Fusion Energie Company SA, Geneva, Switzerland

[21] Appl. No.: 332,056

[22] Filed: Nov. 1, 1994

[30] Foreign Application Priority Data

Nov. 1, 1993 [CH] Switzerland ..... 3288/93

[51] Int. Cl.[6] ..... B22F 7/00

[52] U.S. Cl. ..... 428/552; 428/539.5; 428/565; 428/567; 428/568; 75/235; 75/238; 75/244

[58] Field of Search ..... 428/539.5, 548, 428/551, 552, 565, 567, 568; 75/235, 238, 244; 501/96, 153

[56] References Cited

U.S. PATENT DOCUMENTS

| | | | |
|---|---|---|---|
| 3,098,723 | 7/1963 | Micks | 29/183.5 |
| 3,652,304 | 3/1972 | Daniels | 106/57 |
| 4,249,914 | 2/1981 | Ogawa et al. | 51/309 |
| 4,320,203 | 3/1982 | Brandt et al. | 501/87 |
| 4,511,665 | 4/1985 | Nagato et al. | 501/96 |
| 4,528,121 | 7/1985 | Matsushita et al. | 252/516 |
| 4,639,426 | 1/1987 | Nagato et al. | 501/96 |
| 5,173,107 | 12/1992 | Dreyer et al. | 75/229 |
| 5,188,908 | 2/1993 | Nishiyama et al. | 428/698 |
| 5,360,772 | 11/1994 | Hayashi et al. | 501/95 |

FOREIGN PATENT DOCUMENTS

| | | | |
|---|---|---|---|
| 641647 | 5/1962 | Canada | 501/96 |
| 53-127513 | 11/1978 | Japan | 501/153 |
| 53-130208 | 11/1978 | Japan | 75/235 |
| 56-114864 | 9/1981 | Japan | 501/96 |

OTHER PUBLICATIONS

German, Randall M., *Sintering Theory and Practice*, 1996, pp. 13–15.

*Primary Examiner*—Bruce F. Bell
*Assistant Examiner*—Chrisman D. Carroll
*Attorney, Agent, or Firm*—Young & Thompson

[57] ABSTRACT

The ceramic/metal composite material is comprised of a ceramic phase with particles of alumina or of a solid solution based on alumina and a refractory phase including titanium nitride and/or carbonitride and a metallic matrix based on Ni, Co, Fe. The interface between the particles of alumina or the solid solution of alumina and the metallic matrix is rich in nitrogen and in titanium or in compounds thereof.

7 Claims, No Drawings

HIGH TOUGHNESS CERAMIC/METAL COMPOSITE AND PROCESS FOR MAKING THE SAME

FIELD OF THE INVENTION

The present invention is concerned with a high toughness composite material containing an oxide-based reinforcing phase and a manufacturing process therefore.

BACKGROUND OF THE INVENTION

Ceramic/metal composite I materials, sometimes called cermets, can be used both as structural materials (motor parts, aircraft or spacecraft parts) and as functional materials (cutting, drilling and boring tools). In these materials, the purpose is to combine the inherent properties of the ceramic, such as hardness, resistance to wear and a high modulus of elasticity, with those of metals, such as toughness and resistance to mechanical and to thermal shocks.

Among the different ceramics, aluminum oxide or alumina ($Al_2O_3$) is a compound which is most widespread because of its properties: chemical stability, hardness, low density and its competitive price by comparison with the other ceramics in all its forms (fibers, powders, whiskers, etc). However, the toughness and the resistance to shocks of polycrystalline $Al_2O_3$ are very low. For this reason, very often other ceramics are added to alumina based ceramics, such as $ZrO_2$ and $Y_2O_3$ or carbides such as TiC. However, even with such additions, it has never been possible to achieve the toughness of metals and of ceramic/metal composites.

The metals of the group Fe, Ni, Co which are also called ferrous metals, are interesting for high temperature applications, since their melting point is at temperatures well above those reached in most industrial processes, while being readily available for manufacturing purposes. Furthermore, the alloys of the ferrous metals have an excellent resistance to oxidation. The ferrous metals form a pseudo-eutectic at a temperature lower than their melting point in the presence of carbides and carbonitrides such as TiC, TaC, WC, TiCN. These carbides and carbonitrides in association with ferrous metals (mainly Ni and Co) provide the basis for the vast majority of the cermets presently produced.

At the present time, the applications of cermets are at increasingly high temperatures, which causes problems of resistance to oxidation, creep resistance and separation at the interfaces. The introduction of a reinforcing phase based on aluminum oxide could give cermets a better resistance to heat owing to the chemical resistance of $Al_2O_3$ and to its refractory properties. However, the formation of intermediate oxides weakens the interfaces between the alumina and the metal. Furthermore, the poor wetting of alumina by ferrous metals makes impossible the manufacture of such ceramics by sintering.

Various attempts have been made to manufacture cermets based on aluminium oxide and to remedy the above described problems. For instance, in cermets based on TiCN, TiN and Ni, attempts were made to replace a portion of the carbonitride phase by oxides. However, the densification remains a problem in these materials and only a compression at elevated temperature can be envisaged as a method of densification at elevated temperature, while sintering is excluded. To avoid the formation of interface oxides and improve wettability, it was proposed to recover the aluminum oxide with a layer of TiC (U.S. Pat. No. 4,972,353). According to this patent, the sintering could provide a possible method of densification. However, experience with coatings on cutting tools shows that the adhesion between TiC and $Al_2O_3$ is poor and that TiC is fragile. It is well known that metals like titanium which are strongly electropositive increase the wettability of alumina. The addition of this metal is therefore a current practice when preparing a brazing alloy for ceramics. However, even with the addition of titanium, the wetting angle remains too low for the infiltration of the metal into the ceramic to allow a good sintering. In conclusion, despite the research efforts made, the introduction of alumina into cermets does not seem to have produced up to now any significant improvement of their mechanical properties. The reason for this lack of success lies in the poor wettability of alumina (and generally of oxides of an ionic nature) which prevents an optimal densification at elevated temperature and a good adhesion to the matrix.

SUMMARY OF THE INVENTION

The purpose of this invention is therefore to provide a composite material exhibiting a high toughness and the refractory properties which are inherent to ceramics, by providing around the ceramic phase of the oxide, an interface layer ensuring a good wettability and a good toughness of the interface. The ceramic/metal material which is the object of the invention and which is designed for achieving the objective stated above, includes a ceramic phase with alumina particles or a solid solution based on alumina, a refractory phase including nitride and/or titanium carbonitride and a bonding metal phase based on Ni, Co and/or Fe, the interface between the particles of alumina or the solid solution of alumina and the metallic matrix being rich in nitrogen and in titanium or in a compound thereof.

DETAILED DESCRIPTION OF THE INVENTION

The above-mentioned interface is generally formed by a continuous layer rich in TiN around particles of alumina or of a solid solution of alumina, promoting a good wettability of the metallic matrix, and which can contain aluminum in the form of compounds with titanium, nitrogen and/or a metal of the metallic phase, in the vicinity of this metallic matrix.

The alumina can be present in the form of a powder, of which the grains have a diameter of 0.5 to 50 μm and preferably of 0.5 to 10 μm or of monocrystalline platelets having an aspect ratio varying between 5 and 20 and a diameter varying between 5 and 50 μm or further of whiskers or of filaments.

In the ceramic/metal material according to the invention with alumina in the form of a powder, the relative volume of the ceramic phase can be comprised between 10 and 80%, preferably 20 and 50%, that of the refractory phase between 10 and 70% and that of the metallic matrix between 3 and 50%.

When the alumina is in the form of platelets, whiskers or filaments, the content of the ceramic phase is comprised between 5 and 30% in volume, that of the refractory phase is between 35 and 65% in volume and that of the metallic matrix between 5 and 25% in volume.

The ceramic/metal material can also include titanium carbide in addition to the titanium carbonitride or nitride, or a mixture of the three.

Furthermore, the metallic matrix can contain dissolved additional ingredients, for example metals such as Sc, Y, Ti, Zr, Hf, V, Nb, Cr, Re, Ru, Al, C and N, from 0.1 to 5% in volume and the refractory phase carbides of Mo, W, V, Hf, Nb, Cr, Ta or nitrides such as AlN, TaN, ZrN and BN between 0.5 and 15% in volume.

Finally, the ceramic phase can also contain other oxides such as $ZrO_2$ or $Y_2O_3$ or a mixture of these oxides.

Furthermore, another object of the present invention is to provide a manufacturing process for the ceramic/metal composite material defined above, which comprises the sintering of the component elements in a nonoxidizing nitrogen atmosphere at a temperature from 1300° to 1600° C., preferably from 1450° to 1500° C. and a pressure from 1 to 2000 atm, preferably from 1 to 200 atm. It can be combined with a compression at elevated temperature or with an isostatic compression at elevated temperature.

As mentioned previously, one of the main aspects of the present invention is in the forming on the surface of the ceramic phase, of an intermediate layer having an affinity for the matrix, this layer being rich in nitrogen and in titanium. It is well known that metals wet ceramics by forming chemical bonds. When the wetting is poor, the reaction between the metal and the atoms on the surface of the ceramic is not favorable thermodynamically. The presence of a reactive layer can thus provide the driving force necessary for the wetting reaction. The conservation of the interface layer during sintering is ensured through the provision of the nitrogen and of a metallic element, preferably titanium, in solution in the matrix. A nitride coating is thus obtained. The energy produced by this reaction during the sintering increases the wetting and the epitaxial precipitation of the nitride guarantees the homogeneity and the toughness of the interface. The interface layer can be obtained by a PVD or a CVD process, in which case it will have a thickness between 0.5 and 5 μm, or by nitriding $Al_2O_3$ before sintering or during the sintering in an inert atmosphere of nitrogen, in which case it will have a thickness between 10 and 1000 nm. The nitriding can be assisted by an adjunction of carbon, which makes possible the reduction of the alumina. The most favourable sequence of the possible chemical reactions is as follows:

$$1)\ Al_2O_3+3C+N_2 \rightarrow 2AlN+3CO\uparrow$$

$$2)\ AlN+Ti \rightarrow TiN+Al$$

followed by the reaction of formation of the nitride layer:

$$3a)\ 2Ti+N_2 \rightarrow 2TiN$$

One can also form a carbonitride via the reaction:

$$3b)\ 2Ti+(1-x).N_2+2x.C \rightarrow 2TiC_xN_{1-x}$$

Another possibility is the deposition of a layer of TiN or of TiCN on the ceramic before the sintering. In this case, the wetting is ensured by the reactions of formation 3a, b.

The preparation of the composite material includes generally firstly the mixing of the powders of the binding phase and in particular, a slip is prepared by mixing the powders of the binding phase with a liquid organic product such as polyethylene glycol. The slip is mixed for 12 hours in a ball mill and then deaerated to adjust viscosity. The ceramic of oxides is added to this mixture. A moderate milling of this final mass is necessary for achieving a good homogeneity. Thereafter, the parts are shaped, which operation can be carried out by dry compression, filter pressing, molding of the slip, extrusion or injection. The shaped parts are then sintered. A pre-sintering at a temperature between 300° and 700° C. can be necessary to remove completely the organic binder. The sintering is carried out at a temperature between 1300° and 1600° C. for 1–4 hours under nitrogen at a pressure between $5.10^4$ and $2.10^8$ Pa.

The thickness of the interface between the particles of alumina and the metallic matrix is from 100 to 1000 angstroms when it is obtained by prior surface nitriding of said particles. On the other hand, this thickness can be from 0.1 to 1 μm if the interface is obtained after chemical deposition of a titanium compound on the particles of alumina and from 0.05 to 5 μm in the case of this interface being obtained during sintering.

The composite material according to the invention and the preparation process thereof will now be illustrated more in detail with reference to the following examples:

EXAMPLE 1

Platelets of monocrystalline αalumina of a diameter from 5 to 10 μm and of a thickness of about 0.3 μm, mixed with TiCN containing the same number of atoms of carbon and nitrogen, TiN, molybdenum carbide, nickel and carbon in the form of graphite.

Sample 1: 10% $Al_2O_3$+90% (TiCN 65%, TiN 19%, $Mo_2C$ 5%, C 1%, Ni 10%)

The powders for the matrix of the composite were mixed beforehand with 2% polyethylene glycol and comminuted for 12 hours in a ball mill. The platelets of $Al_2O_3$ were then added to the slip and the mixture was mixed in a ball mill for 2 hrs. This mixture is thereafter air-dried at 50° C., disaggregated in a ball mixer and dry-pressed under a pressure of 140 MPa. The sintering is then carried out at 1500° C. for 1 hr under an atmosphere of nitrogen.

EXAMPLE 2

Powder of α-alumina mixed with TiCN, TiN, molybdenum carbide and nickel.

Sample 2: 30% $Al_2O_3$+70% (TiCN 65%, TiN 19%, $Mo_2C$ 5%, C 1%, Ni 10%)

The powders of the composite are mixed with 2% polyethylene glycol and milled for 12 hr in a ball mill. This mixture is then dried in air at 50° C., disaggregated in a ball mixer and dry-pressed under a pressure of 140 MPa. The sintering is carried out subsequently at 1500° C. for 1 hr under an atmosphere of nitrogen.

EXAMPLE 3

Platelets of monocrystalline α-alumina covered with TiN, mixed with TiCN, TiN, molybdenum carbide, nickel and carbon in the form of a graphite powder.

Sample 3: 10% $Al_2O_3$ (TiN)+90% (TiCN 65%, TiN 19%, $Mo_2C$ 5%, C 1%, Ni 10%)

The same composition of the matrix is used and also the same process for mixing, shaping, sintering, as in Example 1. The phase which reinforces the alumina consists of platelets coated with a layer of TiN according to the process described below.

$Al_2O_3$ platelets suspended in hexane are introduced into a laboratory autoclave. The $Al_2O_3$ platelets are dispersed in the hexane for 15 minutes with an ultrasound emitter. A 10% solution of $TiC_4$ in hexane is then introduced and at the same time, a flow of gaseous ammoniac is passed through for ten minutes. The $TiCl_4NH_3$ complex thus formed precipitates on the platelets. The powders obtained were then dried under vacuum. After this treatment, the powders are subjected to an oxidation in a furnace at 900° C. under air for 1 hr. The powders obtained are mixed with an equal weight of free-flowing graphite powder and heated at 1150° C. under a flow of nitrogen. This temperature is maintained for 4 hrs. Thus, a coating of TiN of less than 1 μm is obtained on the surface of the powder of $Al_2O_3$, according to the reaction:

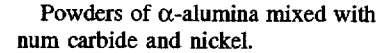

4) $2TiO_2+4C+N_2 \rightarrow 2TiN+4CO\uparrow$

EXAMPLE 4

Powders of α-alumina mixed with TiCN, TiN, molybdenum carbide and nickel.

Sample 4: 30% $Al_2O_3$+70% (TiCN 65%, TiN 20%, $Mo_2C$ 5%, Ni 10%)

The process of formation of the reactive layer on the particles of oxide can be speeded up and improved by sintering under a pressure of nitrogen. In this Example, a sample of the same composition and the same shaping process are used as in Example 2. The sintering is carried out under a pressure of nitrogen of 100 atmospheres, while keeping the temperature at 1450° C. for 20 minutes.

EXAMPLE 5

A powder of α-alumina mixed with TiCN, TiN, TiC, molybdenum carbide and nickel.

Sample 5: 30% $Al_2O_3$+70% (TiCN 65%, TiN 5%, TiC 15%, $Mo_2C$ 5%, Ni 10%)

The TiN of the refractory phase is therefore replaced partly by TiC in this sample. In this Example, the same mixing, shaping and sintering procedures are used as those in Example 2.

EXAMPLE 6

Control Cermets

Sample 6: 10% $Al_2O_3$+90% (TiCN 65%, TiN 19%, $Mo_2C$ 5%, C 1%, Ni 10%)

Same composition as that of Sample 1, but obtained by sintering under argon at 1 atmosphere.

Sample 7: 30% $Al_2O_3$+70% (TiCN 65%, TiN 20%, $Mo_2C$ 5%, Ni 10%)

The same composition as that of Sample 2, but obtained by sintering under argon at 1 atmosphere.

Sample 8; TiCN 65%, TiN 20%, $Mo_2C$ 5%, Ni 10%. Absence of any reinforcing phase ($Al_2O_3$); obtained by sintering under nitrogen.

EXAMPLE 7

After the sintering of the samples, specimens were cut out with a blade carrying diamonds for the characterization of the samples; sintered tablets are embedded in a resin and polished for the analysis or their microstructure. The microstructure of the composite materials according to the invention (Samples 1 to 5) shows that the particles of aluminum oxide are uniformly dispersed in a phase consisting of islets of metal in a ceramic framework of titanium carbonitride. The metal surrounds also the particles of oxide. The interface between the metal and the oxide, which has a thickness between 0.03 and 0.1 μm, consists mainly of titanium nitride.

The characterization of the mechanical properties of the samples was carried out by measuring the Vickers hardness (Hv) and the toughness $K_{IC}$, and the results are given together in the table below.

TABLE

Mechanical properties of the samples.

| Sample | Hardness Hv (kg/mm²) | Toughness $K_{IC}$ (MPa m$^{1/2}$) |
|---|---|---|
| 1 | 1487 | 11.9 |
| 2 | 1422 | 10.9 |
| 3 | 1305 | 10.6 |
| 4 | 1510 | 12.8 |
| 5 | 1498 | 12.1 |
| 6 (control) | 1235 | 7.3 |
| 7 (control) | 1250 | 7.0 |
| 8 (control) | 1540 | 6.9 |

It is clearly apparent from the above examples, that the present invention makes it possible to improve substantially the toughness of cermets, while retaining a high hardness, through the introduction of particles of alumina, this being possible if the alumina is treated before or during the sintering in such a manner as to promote the formation of an interface rich in nitrogen and titanium. One can also note that the sintering under pressure (Sample 4) makes it possible to obtain excellent mechanical properties with an important reduction of the duration of said sintering.

We claim:

1. A sintered ceramo-metallic composite material comprising a ceramic phase of particles of alumina or a solid solution based on alumina, titanium carbonitride, and a metallic binding matrix selected from the group consisting of metallic nickel, metallic cobalt and metallic iron, said titanium carbonitride comprising an interface between said particles and said metallic matrix that causes said metallic matrix to wet to said particles, the volume of the ceramic phase being between 5 and 80% of the whole, that of the titanium carbonitride being between 10 and 70% of the whole and that of the metallic matrix being between 5 and 25% of the whole.

2. A ceramic metallic composite material as claimed in claim 1, wherein said metallic matrix is metallic nickel.

3. A ceramo-metallic composite material as claimed in claim 1, wherein said interface between said particles in the metallic matrix has a thickness of about 0.01 to 5 μm.

4. A ceramo-metallic composite material as claimed in claim 1, wherein said particles are in the form of powder whose grains have a diameter of 0.1 to 50 μm.

5. A ceramo-metallic composite material as claimed in claim 4, wherein said grains have a diameter of 0.5 to 10 μm.

6. A ceramo-metallic composite material as claimed in claim 1, wherein said particles are in the form of microcrystalline platelets with an aspect ratio in the range between 5 and 20.

7. A ceramo-metallic composite material as claimed in claim 1, wherein said particles are in the form of microcrystalline platelets having a diameter between 5 and 50 μm.

* * * * *